US008257102B2

(12) United States Patent
Delgado et al.

(10) Patent No.: US 8,257,102 B2
(45) Date of Patent: Sep. 4, 2012

(54) BUSBAR ELECTRICAL POWER CONNECTOR

(75) Inventors: Eladio Clemente Delgado, Burnt Hills, NY (US); Ljubisa Stevanovic, Niskayuna, NY (US); Richard Alfred Beaupre, Pittsfield, MA (US)

(73) Assignee: General Electric Company, Niskayuna, NY (US)

( * ) Notice: Subject to any disclaimer, the term of this patent is extended or adjusted under 35 U.S.C. 154(b) by 85 days.

(21) Appl. No.: 12/792,967

(22) Filed: Jun. 3, 2010

(65) Prior Publication Data

US 2011/0300725 A1 Dec. 8, 2011

(51) Int. Cl.
*H01R 13/64* (2006.01)

(52) U.S. Cl. ..... 439/247; 257/177

(58) Field of Classification Search ..... 257/177; 439/62, 246, 247, 947
See application file for complete search history.

(56) References Cited

U.S. PATENT DOCUMENTS

| | | | | |
|---|---|---|---|---|
| 4,692,120 | A * | 9/1987 | Feinstein | 439/62 |
| 4,838,800 | A * | 6/1989 | Lynch | 439/78 |
| 5,145,381 | A * | 9/1992 | Volz | 439/62 |
| 5,306,158 | A * | 4/1994 | Endo et al. | 439/59 |
| 5,427,533 | A * | 6/1995 | Chambers | 439/62 |
| 5,431,576 | A * | 7/1995 | Matthews | 439/247 |
| 6,089,929 | A | 7/2000 | Sloey | |
| 6,347,950 | B1 * | 2/2002 | Yokoyama et al. | 439/248 |
| 6,442,033 | B1 | 8/2002 | Liu et al. | |
| 6,623,284 | B1 * | 9/2003 | Korsunsky | 439/83 |
| 6,994,563 | B2 * | 2/2006 | Amini et al. | 439/62 |
| 7,014,516 | B2 * | 3/2006 | Yang | 439/845 |
| 7,029,285 | B2 * | 4/2006 | Abe | 439/62 |
| 7,232,710 | B2 | 6/2007 | Hsu | |
| 7,499,290 | B1 | 3/2009 | Mazzola | |
| 7,581,972 | B2 * | 9/2009 | Daamen | 439/249 |
| 2005/0233644 | A1 | 10/2005 | Bogiel et al. | |
| 2005/0277336 | A1 | 12/2005 | Yang | |
| 2008/0238520 | A1 | 10/2008 | De Rooij et al. | |

FOREIGN PATENT DOCUMENTS

WO WO2007002589 1/2007

OTHER PUBLICATIONS

Search Report from corresponding EP Application No. 11168365.2-1231 dated Aug. 1, 2011.
Tyco Electronics: "Tyco—AMP & ELCON Power Connectors & Interconnection Systems" , pp. 149-152 , Aug. 31, 1995.

* cited by examiner

*Primary Examiner* — Thanh Tam Le
(74) *Attorney, Agent, or Firm* — Scott J. Asmus

(57) ABSTRACT

A dual pole busbar power connector including opposing elements configured to form a slot configured to receive a dual-pole blade therebetween. The slot extends from busbars to opposing element distal ends. The opposing elements each includes: a first contact extending into the slot from the opposing element; and a second contact extending into the slot from the opposing element and disposed farther from a slot busbar end than the first contact. When the dual-pole blade is inserted in the slot the first contact contacts a respective blade element at a location in the slot more proximate the slot busbar end than a slot distal end.

22 Claims, 4 Drawing Sheets

BUSBAR ELECTRICAL POWER CONNECTOR

FIELD OF THE INVENTION

The present invention is related to power connectors. In particular, the present invention is related to a dual pole power connector for enabling a power connection to dual pole parallel power busbars.

BACKGROUND OF THE INVENTION

Transmission of power through an electric circuit results in energy losses. In circuits where the voltage does not remain constant, such losses may be the result of many factors, including conductive losses as well as losses associated with a voltage that changes, such as inductive losses and capacitive losses. Conductive losses include heat loss resulting from resistance of the conductors and electrical connectors between conductors. Inductive losses may be proportional to a frequency of voltage change and a circuit's inductance, and/or a speed of a voltage change and the circuit's inductance. A circuit's inductance may be influenced by the geometry of the circuit itself, or the geometry of the electrical connector itself.

The nature of power transmitted through electric circuits is continuously changing. For example, in switched circuits, the speed at which a voltage may change is constantly increasing with the onset of new more advanced high switching speed semiconductors. This is a consequence of the new semiconductor technology and the need to obtain high power density in electronic circuits. Consequently, because inductive losses are proportional to a speed of a voltage change, and are related to the geometry of the circuit, increased attention must be paid to the geometry of electrical connectors in order to minimize inductive losses. Thus, there remains room in the art for improvement.

BRIEF DESCRIPTION OF THE INVENTION

An embodiment is directed toward a dual pole busbar power connector including opposing elements configured to form a slot configured to receive a dual-pole blade therebetween. The slot extends from busbars to opposing element distal ends. The opposing elements each includes: a first contact extending into the slot from the opposing element; and a second contact extending into the slot from the opposing element and disposed farther from a slot busbar end than the first contact. When the dual-pole blade is fully inserted in the slot the first contact mates a respective blade element at a location in the slot more proximate the slot busbar end than a slot distal end.

Another embodiment is directed toward a dual pole electrical connector including: at least one electrically conductive element for each busbar of a dual parallel busbar power conversion equipment, the electrically conductive element including a first contact, wherein when a dual-pole blade is inserted into the dual pole electrical connector the first contact electrically connects a respective busbar to a respective blade element via a first element first contact path. The first element first contact paths of respective poles form a loop comprising an region therebetween comprising a cross section, and a dual pole electrical connector inductance is influenced by a size of the cross section, and the cross section is configured by the first contact paths to keep the dual pole electrical connector inductance below seven nanohenries.

BRIEF DESCRIPTION OF THE DRAWINGS

The invention is explained in the following description in view of the drawings that show.

DETAILED DESCRIPTION OF THE INVENTION

Figure 1:
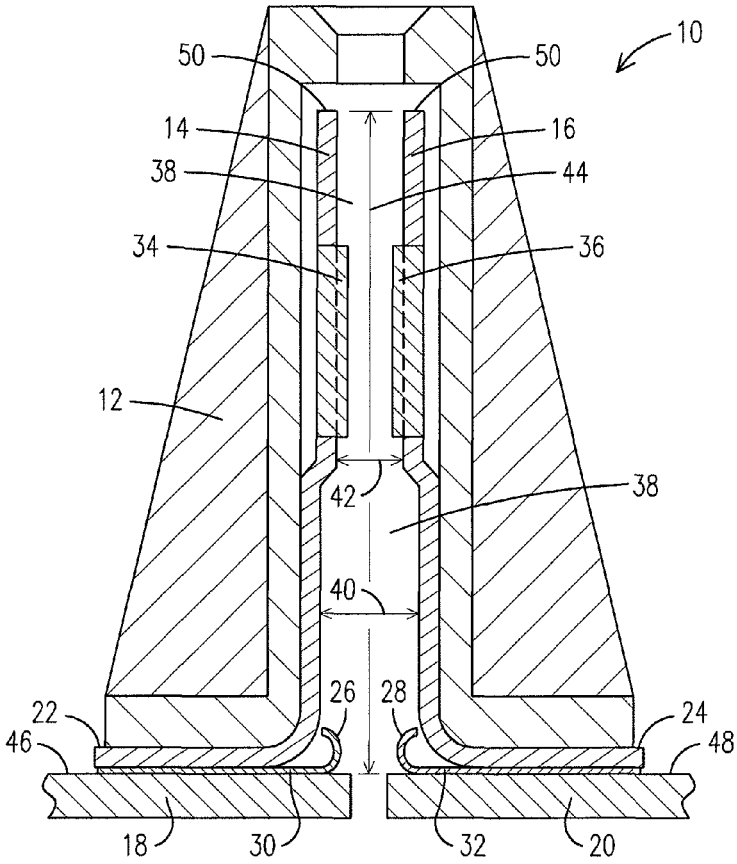
FIG. 1 shows a cross section of a side view of an electrical connector.

New semiconductor technologies are capable of providing much faster switching than has been seen in the art. Specifically, when a voltage is changed from a first voltage to a second voltage the change ideally would be instantaneous. Were this signal profile depicted on a graph with voltage on the y-axis and time on the x-axis, the line representing the voltage would, ideally, be vertical when the voltage changed. This line, i.e. the signal edge, however, is not vertical, and historically this has been the result of the switching technology. However, with the advent of switching technology using silicon carbide, for example, the switching equipment is capable of much faster transitions, i.e. the signal edge slope is significantly steeper. However when the new switching technology was used with conventional circuit hardware, including the electrical connectors, the expected increased efficiency of the relatively "faster edge" was not realized to its potential. Upon initial investigation it was discovered that efficiency gains realized by the faster edge were being offset by increased losses in the conventional circuit hardware associated with that same faster edge. Upon further investigation, it was discovered that certain prevalent conventional connectors, such as Tyco/Elcon "Crown Clip" connectors, as well as Anderson Power Products "Power Clip" connectors, possess certain geometries. Without being bound by any particular theory, it is believed that this geometry, which may best be considered a "loop" in terms of its contribution to the total inductance of the electrical connector, causes electrical losses in the circuit because it resists the change of faster edge switching. The inductance of the geometry has been present even with relatively slow edge switching, but the losses were negligible because the transition was slower. However, as the edge speed increases the losses are no longer negligible. The identified geometry is like a loop in the traditional sense of the term, where one may envision a coiled wire, and thus identification of the inductance inducing geometry was a significant step in itself.

In addition, with the advent of the "faster edges," switching frequencies themselves can in turn be increased. For example, frequencies of 10 kHz have been possible with relatively slower edge technologies. However, switching equipment had been the limiting factor because that technology had a relatively long transition time (edge) between the first and second voltages. However, with the advent of the new switching technologies, the switching equipment was not the limiting factor anymore, but as described above, the hardware had become the limiting factor. However, the demand for higher switching speed remains, and thus the recognition of the conventional geometry and innovative new design will permit switching speeds to increase in excess of 500 kHz, making the resulting geometry, although seemingly simple, critical for technological advancement.

Inductance resulting from loops in an electrical circuit, i.e. a signal path, can be modeled with various known equations, but in general terms if one wants to reduce or eliminate a loop one can reduce a cross sectional of a region bound by the conductor(s) that form the loop (i.e. the cross section). As a result, the inventors have devised a power connector that significantly changes the current flow path geometry present in connectors of earlier designs, minimizing the region, and hence the cross section of the region, bounded by the conductors forming the loop. They have done this by adding an electrical contact at a point close to the busbar. The relevance of the contact, it is believed, is that its location is specifically chosen to reduce the cross section of the region bound by the newly identified inductance causing loop.

The connector described below is suited for making an electrical connection between parallel busbars, each busbar being part of a single circuit, and a blade that is inserted into a slot in the connector, shown later. Thus, as used herein, a dual pole connector is a connector used to establish electrical communication between at least two busbars of a single circuit, and a component to be run off that circuit, where circuit comprises a first busbar, the component, and a second busbar. Turning to the drawings, FIG. 1 shows a side view of a dual pole busbar power connector ("connector") 10. The connector has a housing 12 to hold two opposing elements, first element 14 and second element 16. In an embodiment these are electrically connected to first busbar 18, which serves as one pole of a circuit, and second busbar 20, which serves as a second pole of a circuit, respectively, via first element flanged end 22 and second element flanged end 24. However, this electrical connection may be made in any manner known to those of ordinary skill in the art. First element 14 may include first element first contact 26, and second element 16 may include second element first contact 28. In an embodiment, first element first contact 26 may be in electrical communication with first busbar 18 via a first element first contact plate 30, and second pole first contacts may be in electrical communication with a second busbar 20 via a second element first contact plate 32. However, again, electrical communication between the first contacts and the busbars may be made in any manner known to those of ordinary skill in the art. In an embodiment, first element first contact 26 and second element first contact 28 may be resilient and may oppose each other. First element 14 may include first element second contact 34, and second element 16 may include second element second contact 36. These second contacts may be resilient and may oppose each other. Any contacts in the embodiments may also include a plurality of contacts, or a line or plane of contact, and may extend across a width of the any surface they are intended to contact. It can be seen that a slot 38 is formed between the first element 14 and second element 16. In an embodiment it can also be seen that a distance 40 between first element 14 and second element 16 at the first contacts 26, 28 is greater than a distance 42 between first element 14 and second element 16 at the second contacts 34, 36. Slot 38 has slot length 44, which is a distance from first busbar surface 46 and second busbar surface 48 to distal ends 50 of the first element 14 and second element 16.

Figure 2:
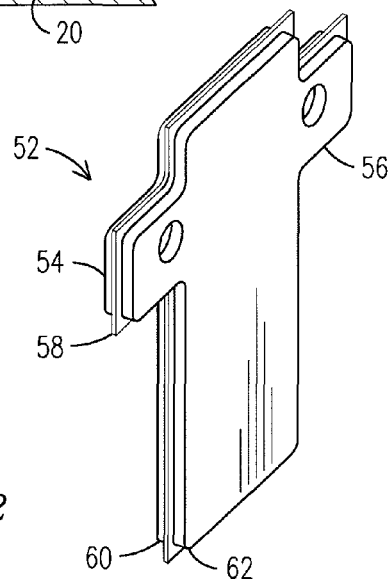
FIG. 2 shows a perspective view of a blade commonly used with the electrical connector of FIG. 1.

A dual pole blade 52 as shown in FIG. 2 is inserted into slot 38. Dual pole blade 52 may include a first blade element 54 and a second blade element 56 separated by an insulator 58. First blade element 54 includes first blade element tip 60 and second blade element 56 includes second blade element tip 62, which is the portion of the dual pole blade that is first inserted into slot 38 and when fully inserted rests closest to the first busbar 18 and second busbar 20.

Figure 4:
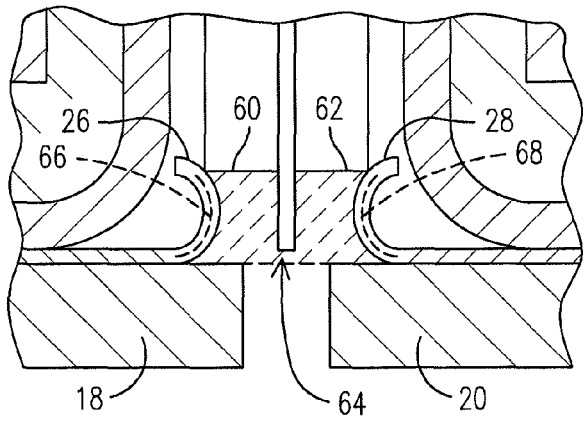
FIG. 4 is a close up of a portion of FIG. 3.
Figure 3:
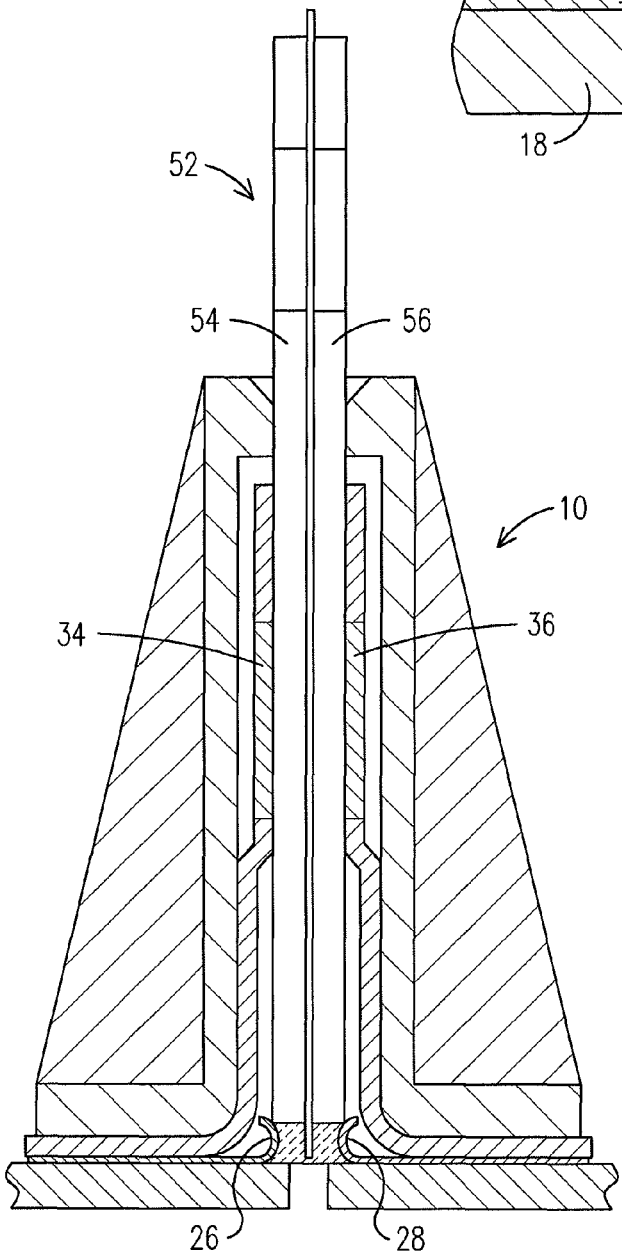
FIG. 3 shows a cross section of a side view of the electrical connector of FIG. 1 with the blade of FIG. 2 inserted.

FIG. 3 shows the dual pole blade 52 inserted into the connector 10. It can be seen in an embodiment that first element first contact 26 contacts the first blade element 54 at first blade element tip 60, and second element first contact 28 contacts second blade element 56 at second blade element tip 62. First element second contact 34 contact first blade element 54 at a location farther from the busbars, and likewise second element second contacts 36 contact the second blade element 56 at a location farther from the busbars. As can be seen in FIG. 4, which is an amplified view of first element first contact 26 and second element first contact 28, cross section 64 of the region bounded in part by a first element first contact path 66 and a second element first contact path 68. Also seen is the first element first contact path 66, which is the path from the first element first contact 28 where it contacts the first busbar 18, through the first element first contact 26, to where the first element first contact 26 makes contact with the first blade element 54. Similarly, the second element first contact path 68 is the path from the second element first contact 28 where it contacts the second busbar 20, through the second element first contact 28, to where the second element first contact 28 makes contact with the second blade element 56.

Figure 5:
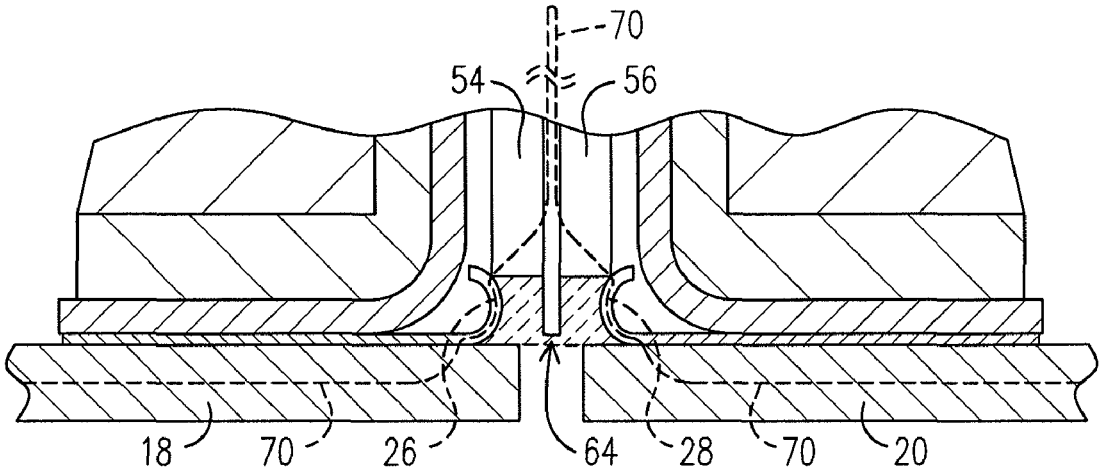
FIG. 5 schematically shows a current path through the connector of FIG. 1.

Thus, as can be seen in FIG. 5, the identified geometry, loop 70, follows the current path from the first busbar 18, through the first element first contact 26, up the first blade element 54, returning down the second blade element 56, through the second element first contact 28, to the second busbar 20.

Figure 6:
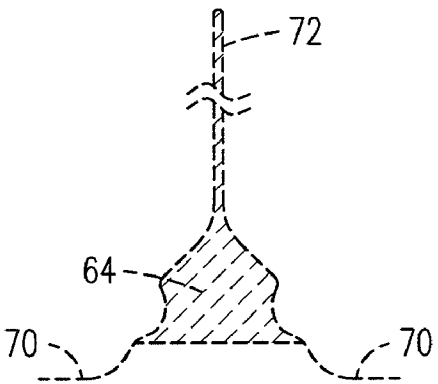
FIG. 6 schematically shows the current loop of FIG. 5 and a cross section of the region bounded by the current path.

FIG. 6 a schematic of the shape of first contact loop 70 of FIG. 4, showing cross section 64, and second cross section 72. Second cross section 72 is shown to illustrate the concept, because there is a region, albeit very small, between the first blade element 54 and the second blade element 56. However, second cross section 72 is small relative to cross section 64, and its contribution to the inductance of the connector is relatively negligible. Further, it is relatively difficult to eliminate this region due to the electrical need to keep the first blade element 54 and the second blade element 56 electrically isolated. As a result, the cross section 64 receiving attention can be described as a cross section of the region bound by the first element first contact path 66 and the second element first contact path 68.

In the embodiment shown in FIG. 6, cross section 64 has already been configured to be as small as possible because the first element first contact path 66 and the second element first contact path 68 are as short as possible, and are also close together. Either of these factors can be used to sufficiently reduce the cross section, and in this embodiment both are used for maximum benefit. It is this configuration, which has the most minimized cross section 64, which permits the relatively fast edge signals to propagate through the connector with the least limiting inductance.

Figure 7:
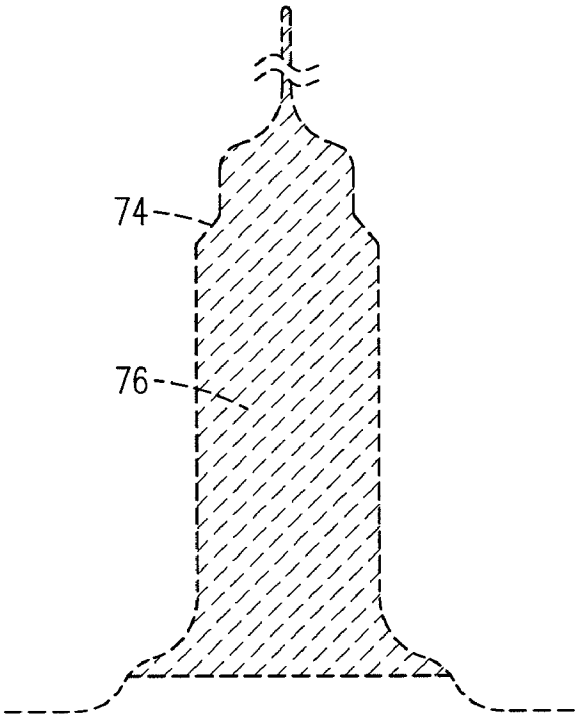
FIG. 7 schematically shows an alternate current loop and a cross section of the region bounded by the current loop.

By way of comparison to FIG. 6, shown in FIG. 7 is second contact loop 74 that current would travel along if first element first contact 26 and second element first contact 28 were not present. In that case electrical communication with the first blade element 54 and a second blade element 56 would be through the first element second contact 34 the second element second contacts 36 respectively, which results in second contact loop 74. As shown in FIG. 7 when compared to FIG.

6, the cross section 76 bounded by this second contact loop 74, i.e. this geometry, is much larger, and consequently would have a much larger inductance relative to the geometry of FIG. 5.

The inventors have found that connectors with contact paths similar to that of FIG. 7 have inductance of seven nanohenries and above. They have also found that connectors with geometries similar to that of FIG. 5 have inductance of below seven nanohenries. In certain embodiments, such as those shown in FIG. 5, these connectors have inductances of 1 to 1.5 nanohenries. Any reduction in the cross section of the region bounded by the current path over that of other configurations will correspond to a reduction in the inductance, and therefore any reduction in cross section is an improvement. Thus, it can be seen that the geometry disclosed in FIG. 1 is a significant improvement over other geometries used in the art.

Figure 8:
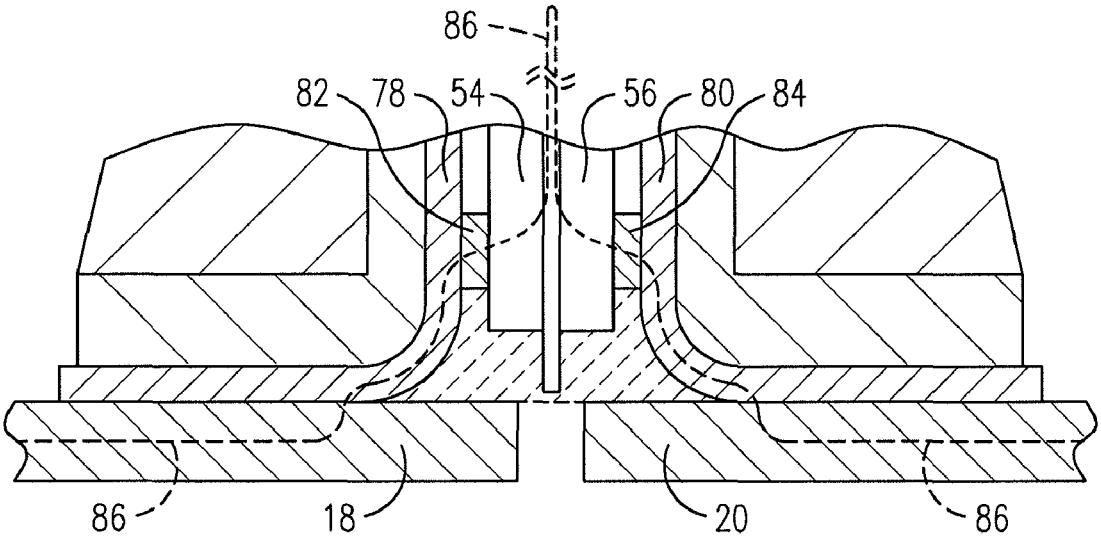
FIG. 8 shows a cross section of a side view and current path of another embodiment of an electrical connector.
Figure 9:
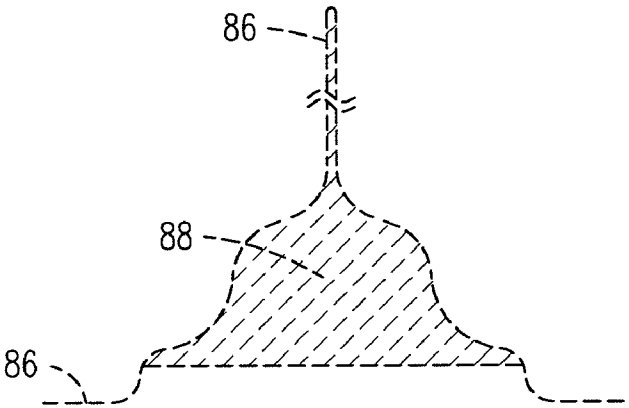
FIG. 9 schematically shows the current path of FIG. 8 and a cross section of the region bounded by the current path.

In an alternate embodiment shown in FIG. 8, connector 10 has first element 78 and second element 80. Each in turn has first element first contact 82 and second element first contact 84 respectively. The loop 86 that the current would follow through this embodiment would be similar to the other loops. As shown in FIG. 9, the cross section 88 bounded by the geometry is a little larger than that shown in the embodiment of FIG. 5, but still less than that shown in FIG. 7, and thus an advantage is still realized over other configurations. Various other configurations are envisioned to be within the scope of this disclosure, so long as those configurations reduce the cross section of the region bounded by the current path below that of the other configurations. It is further noted that some of the current may flow through the second contacts of the connectors, and thus not all the current will be subject to the improved geometry, but enough of the current will follow the improved current paths that the above described improvements will be realized. Other considerations may require the presence of the second contacts, such as stabilizing the blade, or increasing contact area in order to maximize current flow capacity, and thus they have not necessarily been eliminated from every embodiment. Conversely, they may not be present in an embodiment where their presence is not needed.

While various embodiments of the present invention have been shown and described herein, it will be apparent that such embodiments are provided by way of example only. Numerous variations, changes and substitutions may be made without departing from the invention herein. Accordingly, it is intended that the invention be limited only by the spirit and scope of the appended claims.

The invention claimed is:

1. A dual pole busbar power connector comprising:

opposing elements configured to form a slot configured to receive a dual-pole blade therebetween, the slot extending from busbars to opposing element distal ends, the opposing elements each comprising:

a first contact extending into the slot from the opposing elements;

a second contact extending into the slot from the opposing elements and disposed farther from a slot busbar end than the first contact;

wherein, when the dual-pole blade is fully inserted in the slot, the first contact contacts a respective blade element at a location in the slot more proximate the slot busbar end than a slot distal end.

2. The dual pole busbar power connector of claim 1, wherein the first contact contacts the respective blade element at a distance from the busbars that is less than 40% of a slot length.

3. The dual pole busbar power connector of claim 1, wherein the first contact contacts the respective blade element at a distance from the busbars that is less than one third of a slot length.

4. The dual pole busbar power connector of claim 1, wherein the first contact contacts the respective blade element at a distance from the busbars that is less than one quarter of a slot length.

5. The dual pole busbar power connector of claim 1, wherein the first contact is configured such that when the dual-pole blade is inserted, the first contact will contact the respective blade element at a respective blade element tip.

6. The dual pole busbar power connector of claim 1, wherein a distance between the opposing elements at the first contact is greater than a distance between the opposing elements at the second contact.

7. The dual pole busbar power connector of claim 1, wherein the first contact is resilient.

8. The dual pole busbar power connector of claim 1, wherein the first contact comprises a plurality of contacts.

9. The dual pole busbar power connector of claim 1, wherein the first contact comprises a line of contact.

10. The dual pole busbar power connector of claim 9, wherein the line of contact spans a respective blade element contact surface width.

11. The dual pole busbar power connector of claim 1, wherein the opposing elements each comprise:

a first contact component comprising the first contact and a first contact component busbar portion; and a second opposing element component comprising the second contact, wherein the first contact component busbar portion is disposed between a respective busbar and a second opposing element component flanged end.

12. The dual pole busbar power connector of claim 11, wherein the first contact comprises a line of contact.

13. A dual pole electrical connector comprising:

first and second busbars;

first and second electrically conductive elements operatively coupled to the corresponding first and second busbars, the first and second electrically conductive elements configured to form a slot extending from the first and second busbars to distal ends of the first and second electrically conductive elements, each of the first and second electrically conductive elements comprising a first contact, wherein, upon insertion of a dual-pole blade into the slot, each said first contact electrically connects the first and second busbars to the dual-pole blade via first contact paths;

wherein:

the first contact paths form a loop comprising a region therebetween comprising a cross section, an inductance of the dual pole electrical connector is influenced by a size of the cross section, and the cross section is configured by the first contact paths to keep the inductance below seven nanohenries.

14. The dual pole electrical connector of claim 13, wherein the cross section is configured to keep the inductance below five nanohenries.

15. The dual pole electrical connector of claim 14, wherein the cross section is configured to keep the inductance below two nanohenries.

16. The dual pole electrical connector of claim 13, wherein the cross section is configured by sufficiently reducing a length of the first contact paths.

17. The dual pole electrical connector of claim 13, wherein the cross section is configured by sufficiently reducing a distance between the first contact paths.

18. The dual pole electrical connector of claim 13, wherein each of the first and second electrically conductive elements comprises a second contact, wherein, when the dual-pole blade is inserted into the slot, each said second contact electrically connects the first and second busbars to the dual pole-blade via second contact paths at second blade-pole contact points more distal from the first and second busbars than the first contact paths.

19. The dual pole electrical connector of claim 13, wherein when the dual-pole blade is inserted, the first contacts contact a tip of the dual-pole blade.

20. The dual pole electrical connector of claim 13, wherein the first contacts are resilient.

21. The dual pole electrical connector of claim 13, wherein each of the first and second electrically conductive elements comprises:

a first component comprising the first contact; and a second component having a flanged end;

wherein each said first component is disposed between a respective busbar of the first and second busbars and each said flanged end.

22. The dual pole electrical connector of claim 21, wherein the second component comprises a second contact, wherein when the dual-pole blade is fully inserted into the slot, the second contact electrically connects the respective busbar to the dual-pole blade via a second contact path at a second blade element contact point more distal from the busbar than the first contact path.

* * * * *